US006385865B1

(12) United States Patent
Jang et al.

(10) Patent No.: US 6,385,865 B1
(45) Date of Patent: May 14, 2002

(54) MOUNTAIN-CLIMBING SHOES WITH NON SKID INSTRUMENT

(76) Inventors: Soon Sik Jang; Min Jang, both of 106-307 Hyosung APT, Bongduk-2Dong, Nam-Gu, Daegu (KR)

( * ) Notice: Subject to any disclaimer, the term of this patent is extended or adjusted under 35 U.S.C. 154(b) by 0 days.

(21) Appl. No.: 09/678,876

(22) Filed: Oct. 4, 2000

(51) Int. Cl.[7] ..... A43B 23/28; A43B 5/16; A43B 5/00; A43C 15/00

(52) U.S. Cl. ..... 36/61; 36/124; 36/132; 36/134; 36/59 R; 36/62

(58) Field of Search ..... 36/61, 124, 132, 36/134, 59 R, 62, 64, 65, 66, 59 D

(56) References Cited

U.S. PATENT DOCUMENTS

| | | | | | |
|---|---|---|---|---|---|
| 106,747 | A | * | 8/1870 | Wager et al. | 36/61 |
| 1,059,853 | A | * | 4/1913 | Feister | 36/64 |
| 1,942,325 | A | * | 1/1934 | Davidson | 36/61 |
| 2,422,335 | A | * | 6/1947 | Bozek | 36/61 |
| 2,484,389 | A | * | 10/1949 | Schatz | 36/132 |
| 3,343,283 | A | * | 9/1967 | Henry et al. | 36/61 |
| 3,713,233 | A | * | 1/1973 | Hunnicutt | 36/61 |
| 4,226,032 | A | * | 10/1980 | Herro | 36/61 |
| 5,109,617 | A | * | 5/1992 | Nummy | 36/132 |
| 5,231,775 | A | * | 8/1993 | Trent, Jr. | 36/62 |
| 5,299,369 | A | * | 4/1994 | Goldman | 36/61 |
| 5,809,667 | A | * | 9/1998 | Liautaud | 36/124 |
| 6,112,436 | A | * | 9/2000 | Quellais | 36/124 |

* cited by examiner

*Primary Examiner*—Anthony Stashick
(74) *Attorney, Agent, or Firm*—Jacobson Holman, PLLC

(57) ABSTRACT

Mountain-climbing shoes with a non skid instrument are constructed in such a way that two through-holes are formed in the width of the back base of each shoe. Combination holes for setting plates are positioned in both apertures of the through-hole. A screw rod and a fixation rod are provided. A skid prevention part is hinge-combined so as to be supported by the setting plates and is rotatable centering around a rotary shaft pin. An elastic plate having a prolonged hole is fixed onto one side face of the skid prevention part. A fixation body is set on the elastic plate so that the fixation body is movable along the elastic plate. A flute is formed on both side faces of the fixation body and is combined with a protrusion. The fixation pin is inserted into and is fixed to a combination groove or a release groove formed in a righted-angle flute shape on both sides of the setting plate.

8 Claims, 4 Drawing Sheets

MOUNTAIN-CLIMBING SHOES WITH NON SKID INSTRUMENT

BACKGROUND OF THE INVENTION

1. Field of the Invention

The present invention relates to mountain-climbing shoes with a non skid instrument; and more particularly, to mountain-climbing shoes with a non skid instrument, which can be used safely and conveniently on the slippery ground by installing a skid preventing instrument on one side of a back base of the mountain-climbing shoes, to thereby gain its simple and solid wear and its easy release therefrom.

2. Description of the Prior Art

In a general skid preventing instrument for shoes, a plural number of spikes or lugs are formed on a lower face of a main body which is formed in a plate shape, such as climbing irons, and a top of the plate comes in contact with a bottom of the shoes, and then, it is fixed to each other by using a string or a specific fixing member. Such irons should be carried with a user, separately from the shoes, that is, it is caused an inconvenience or a worry for losing, due to its portable and keeping problems, and further is caused a problem with which it is not easy to cope in a case of requiring an unexpected use.

In order to settle such problems of the skid preventing instrument, this invention's applicant had ever applied for a utility model patent in 1998 under No. 20-1998-0010611 which discloses shoes having an installment of a skid preventing instrument. Describing briefly this prior-applied contents, it is constructed that an installment hole is formed on a back base of shoes, a shaft rod having screw parts formed on both ends thereof is piercing-inserted into the installment hole, both ends of the skid preventing instrument are inserted into and combined with both end parts of the shaft rod, and the screw part of the shaft rod is fastened by a nut so that the skid preventing instrument may be rotatable centering around the shaft rod.

However, this prior-applied invention had defects that in combining and releasing the skid preventing instrument having sharp-edged lugs formed to prevent a slippery phenomenon, a device for strongly fixing the skid preventing instrument thereto was unprepared, thus, in case active exercise such as soccer or race was done under a state that the skid preventing instrument was released in order not to use the skid preventing instrument owing to an unpreparedness of the device, the released skid preventing instrument might be suddenly spread and be bumped against other person, causing an injury to the person. Even in a case of putting on it in order to use the skid preventing instrument, a solid wear could not be realized, therefore, there was a danger for a large accident against a safety which threatened a life of the user because of a release of the skid preventing instrument when climbing mountain in the winter season or using on a slippery ground. That is, the prior-applied invention could not be commercialized due to a shortcoming a safety of products falls largely.

SUMMARY OF THE INVENTION

It is, therefore, a primary object of the present invention to provide mountain-climbing shoes with a non skid instrument, in which setting plates are set on both sides of a back base of shoes and are fixed to both sides of the back base by using a fixation rod piercing through the back base of the shoes, the setting plate is provided with a skid prevention part, a fixation body having a formation of a fixation rod is set on an outer side of the skid prevention part, and a fixation flute for a combination and release is formed on a lower face of the setting plate so that the fixation rod of the fixation body may be inserted into the fixation flute of the setting plate, whereby enabling to obtain a solid setting and a simple release of the skid prevention part and use the mountain-climbing shoes more safely and conveniently.

BRIEF DESCRIPTION OF THE ATTACHED DRAWINGS

The accompanying drawings, which are included to provide a further understanding of the invention and are incorporated in and constitute a part of this specification, illustrate embodiments of -the invention and together with the description serve to explain the principles of the invention.

DETAILED DESCRIPTION OF THE PREFERRED EMBODIMENT

Figure 1:
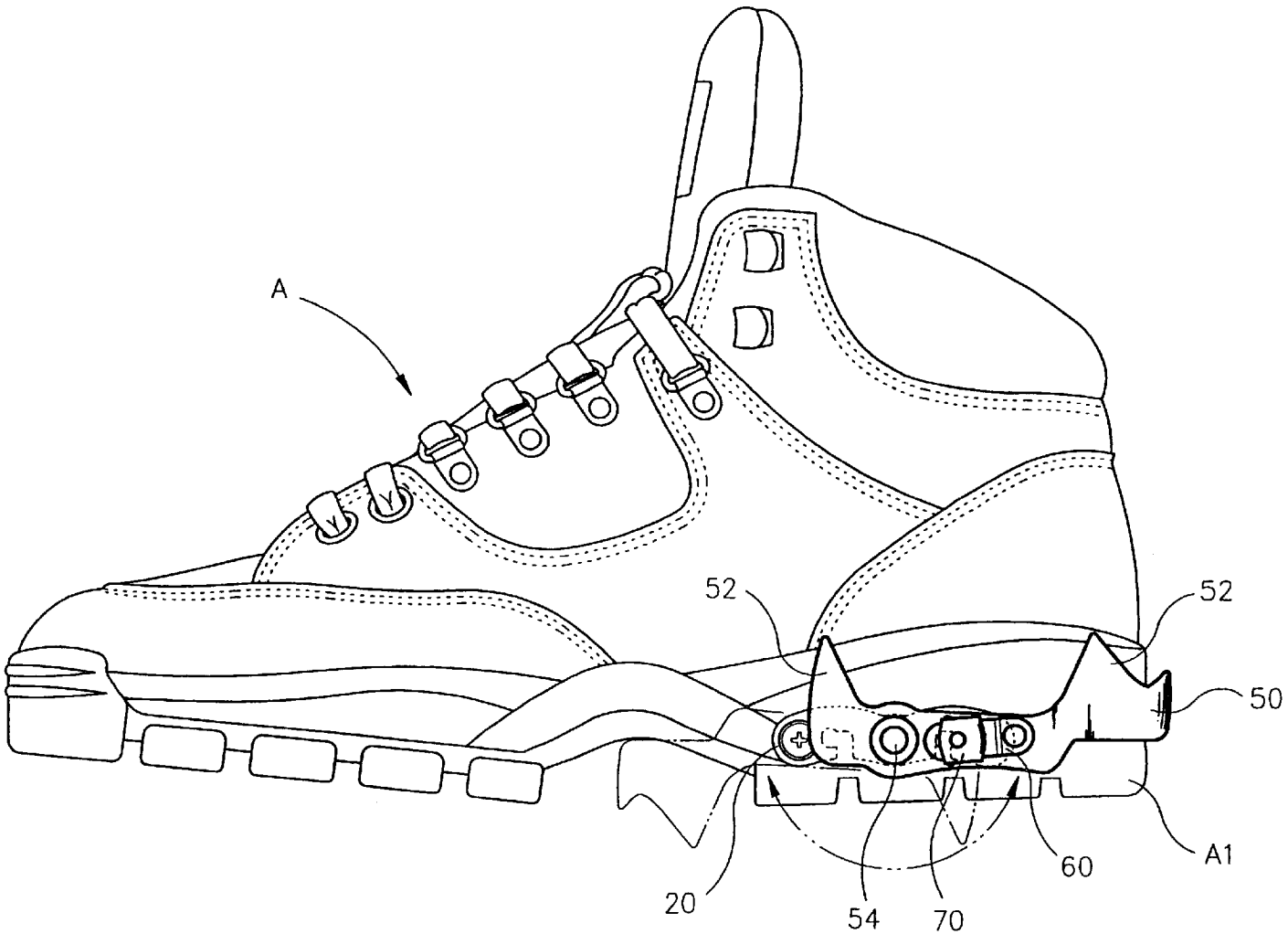
FIG. 1 is an exemplary side view of a shoe showing a state that a skid prevention part is released toward a back side of the shoe, in accordance with the present invention.

Reference will now be made in detail to the preferred embodiments of the present invention, examples of which are illustrated in the accompanying drawings.

In accordance with the present invention, in mountain-climbing shoes A having a back base A1 higher than a front base of a shoe A, mountain-climbing shoes with a non skid instrument is constructed by a characteristic that two through-holes 10 are formed in the back base A1 of the shoe A in a width direction, combination holes 22 of setting plates 20 are positioned in both of opening apertures of the through-hole 10, a screw rod 40 and a fixation rod 30 having a female screw 32 formed on an end part thereof are provided in order for a fixation thereof, and a skid prevention part 50 is hinge-combined so as to be supported by a rotary shaft pin 54 of the setting plate 20 and so as to be rotated centering around the rotary shaft pin 54; an elastic plate 60 having a formation of a prolonged hole 62 is fixed onto one side face of the skid prevention part 50, a fixation body 70 having a fixation pin 72 piercing-inserted into the prolonged hole 62 of the elastic plate 60 and a long hole 56 formed in the skid prevention part 50 is set on the elastic plate 60 so that the fixation body 70 is movable along the prolonged hole 62 of the elastic plate 60, a flute part 74 formed on both side faces of the fixation body 70 is combined with a protrusion part 58 formed on an outer surface of the skid prevention part 50, and on its one side an upward folding part is provided; and the fixation pin 72 of the fixation body 70 is inserted into and is fixed to a combination groove 34 or a release groove 36 formed in a righted-angle flute shape on both sides of the setting plate 20, according to a fixation type of the skid prevention part 50.

The setting plates 20 are formed symmetrically in the right and left and are provided with the combination holes 22 formed on both sides thereof, and an inner side of the combination hole 22 is provided with the combination groove 34 and the release groove 36 each of which is composed of an injection unit 34*a,* 36*a* and a fixation unit 34*b,* 36*b* and which are formed by the righted-angle flute shape, wherein the combination groove 34 and the release groove 36 are set symmetrically in the right and left and are provided with the rotary shaft pin 54 installed in a center thereof.

As shown in FIG. 1, the skid prevention part 50 is installed on the back base A1 of the shoes A. As shown in the drawing, the base A1 of the shoes A backward releases the skid prevention part 50 when the skid prevention part 50 is not used, and when it tries to use the skid prevention part 50, the skid prevention part 50 rotates in a front side so as to be fixed on an operational position, thereby the skid prevention part 50 can be utilized safely and simply.

Figure 2:
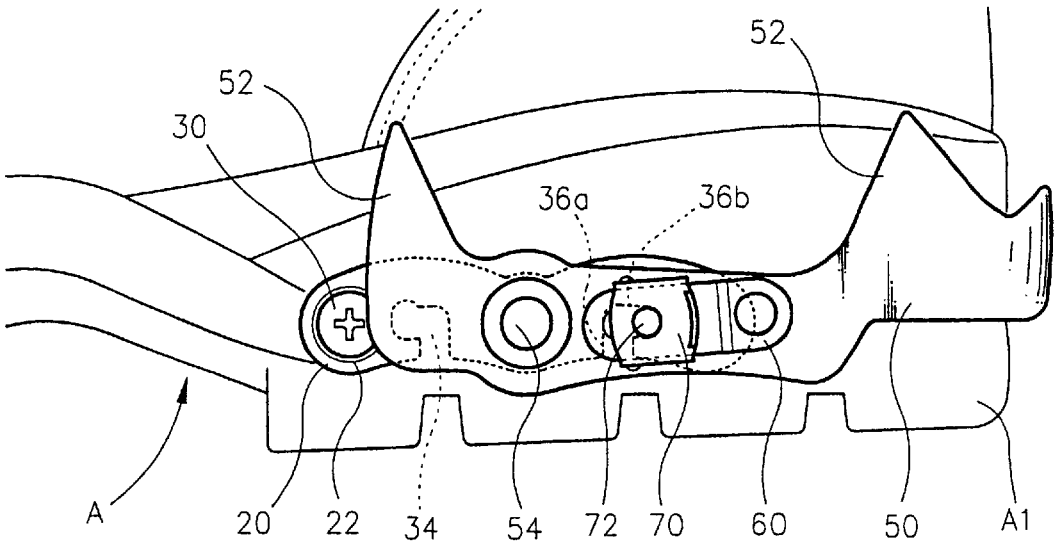
FIG. 2 shows an exemplary view illustrating a release state of the skid prevention part in the present invention.

That is to say, as shown in FIG. 2, when the skid prevention part 50 is not used, the skid prevention part 50 rotates centering around the rotary shaft pin 54 of the setting plate 20 center portion so as to go to a back side of the back base A1 of the shoes A, namely, to a release position. Then, the fixation pin 72 of the fixation body 70 set on side face of the skid prevention part 50 is inserted into the injection unit 36*a* of the release groove 36 formed in the righted angle flute shape on one side of the setting plate 20. Herewith, when the fixation body 70 whose fixation pin 72 is inserted into the release groove 36, is moved to the back side of the shoes A, the fixation pin 72 of the fixation body 70 moves along the prolonged holes 62 and the long hole 56 respectively formed in the elastic plate 60 and the skid prevention part 50, and also the fixation pin 72 inserted into the injection unit 36*a* moves to the fixation unit 36*b* formed by the righted angle direction. Whereby, it can be prevented the fixation pin 72 from sliding down and a rotation of the skid prevention part 50 stops. In addition, the flute part 74 is formed on both side faces of the fixation body 70, in other words, when the fixation body 70 moves, the flute part 74 of the fixation body 70 both side faces is combined with the protrusion part 58 formed on an outer surface of the skid prevention part 50, thus a motion of the fixation body 70 is prevented to strongly cut off an escape of the fixation pin 72 of the fixation body 70 from the fixation unit 36*b* of the release groove 36. Further, the fixation body 70 is made of material having a prominent elasticity, and is set on the elastic plate 60 folded. Namely, when the fixation body 70 is moved by force under a state that the protrusion part 58 is inserted into the flute part 74 of the fixation body 70, the elastic plate 60 is lifted so that the fixation body 70 can be moved and its position is maintained unless its position is changed artificially. Accordingly, a safety can be gotten.

Figure 3:
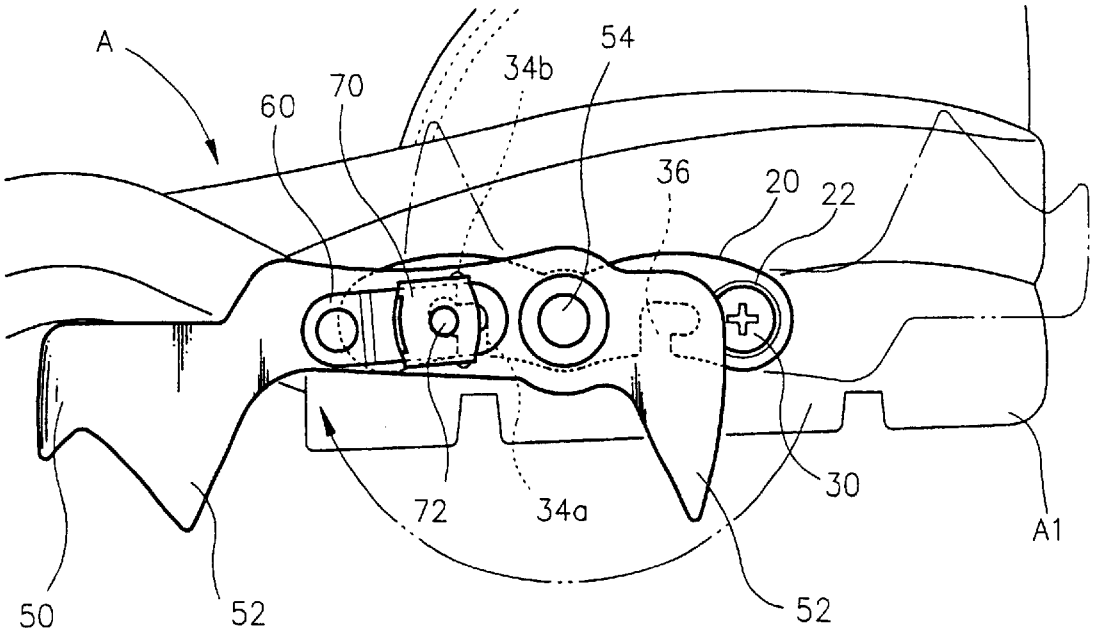
FIG. 3 depicts an exemplary view providing a combination state of the skid prevention part in the invention.
Figure 4:
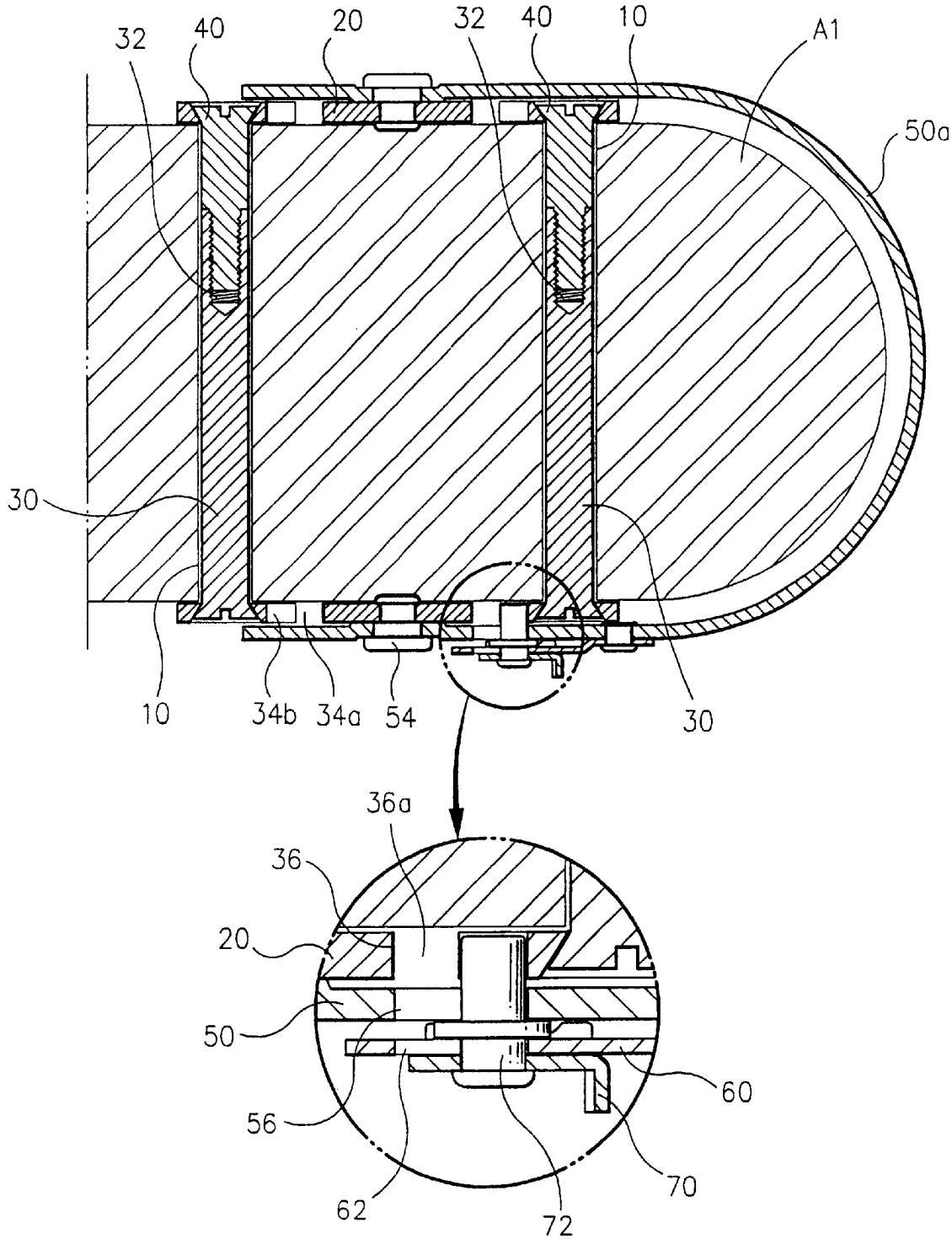
FIG. 4 represents a transversely exemplary view for a main part of the present invention.
Figure 5:
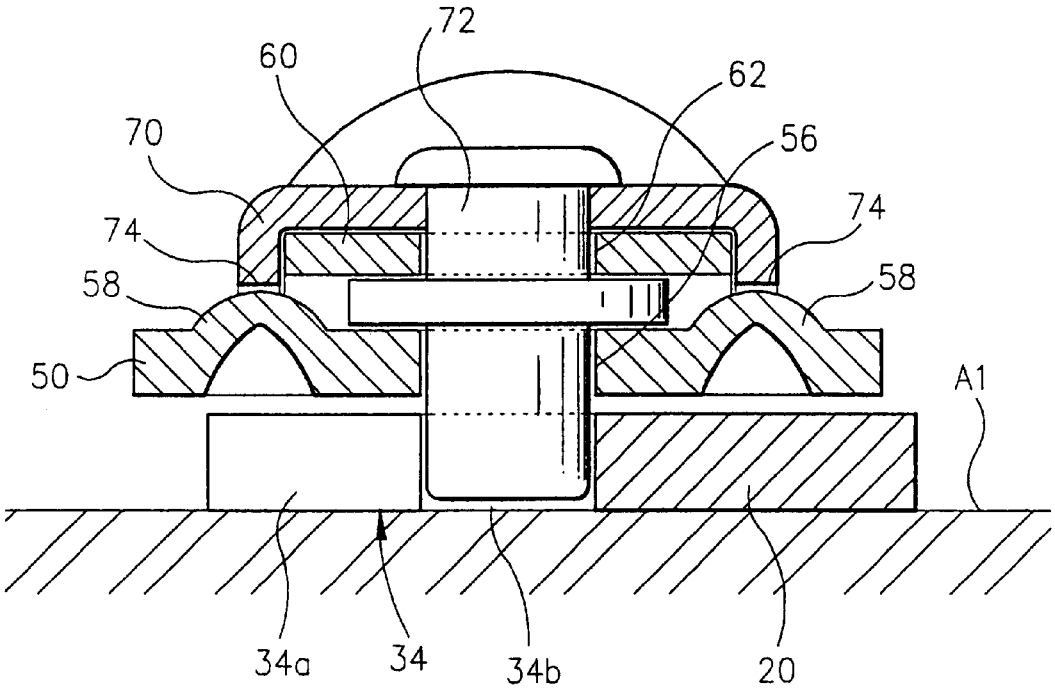
FIG. 5 is a sectional exemplary view showing a fixation body of the invention.
Figure 6:
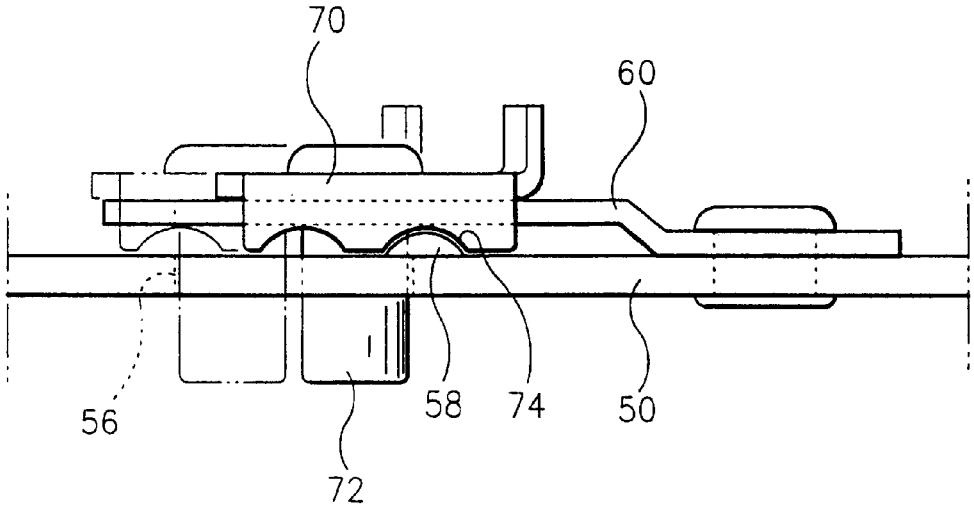
FIG. 6 illustrates a sectional exemplary view representing an operation of the inventive fixation body.

As shown in FIG. 3, meanwhile, when the skid prevention part 50 is tried to be used, the skid prevention part 50 positioned in the back side of the back base A1 of the shoes A, namely, the release position, rotates centering around the rotary shaft pin 54 of the setting plate 20 center portion, and then, a curved face part 50*a* of the skid prevention part 50 is positioned in a front side of the back base A1. At this time, the fixation pin 72 of the fixation body 70 set on side face of the skid prevention part 50 is inserted into the injection unit 34*a* of the combination groove 34 formed in an opposite side to the release groove 36. Herewith, when the fixation body 70 is moved to the front direction, the fixation pin 72 moving together with the fixation body 70 is moved to the fixation unit 34*b* side from the injection unit 34*a* of the combination groove 34, therefore, a rotation of the skid prevention part 50 is stopped and a solid fixation thereof can be obtained. In addition, the skid prevention part 50 can be prevented from being escaped from a fixation position when using the skid prevention part 50, and its safe use is realized according to the inventive objects.

As afore-mentioned, in accordance with the present invention, the shoes is equipped with a skid prevention part capable of preventing mountain-climbing shoes from sliding down, accordingly, a user of the shoes can utilize it conveniently, by fixing the skid prevention part toward a lower face of the shoes or by fixing it so as to be escaped from the shoes lower face, any time, anywhere. Moreover, a combination or release manipulation of the skid prevention part is easy and sure, to thus obtain a useful advantage in ensuring a safe use.

Although the invention has been shown and described with respect to the preferred embodiments, it will be understood by those skilled in the art that various changes and modifications may be made without departing from the spirit and scope of the invention as defined in the following claims.

What is claimed is:

1. A pair of mountain-climbing shoes, each said shoe of said pair having a back heel base and a front sole base, said back heel base being higher than said front sole base, and each said shoe comprising:

a non skid instrument for attaching to said back heel base of each said mountain-climbing shoes;

two through-holes formed in the back heel base of the shoe in a width direction so as to extended completely through said back heel base, setting plates having a plurality of combinations holes, each said combination hole positioned over each of the through-holes, at least one screw rod for entering one of said through-holes and one of said combination holes for mounting one of said setting plates on said back heel base and at least one fixation rod having a female screw formed on an end part for entering the other end of a corresponding through-hole and one of said combination holes for mounting one of said setting plates on said back heel base and receiving said screw rod in said female screw to form a fixation thereof, and at least one skid prevention part having an outer surface, an aperture and a protrusion part formed on said outer surface, said at least one skid prevention part being hinge-combined and having a rotary shaft pin for entering said aperture and connecting said at least one skid prevention part to each said setting plate, with said at least one skid prevention part rotatable centering around the rotary shaft pin;

an elastic plate having a prolonged hole fixed onto the skid prevention part, a fixation body having a fixation pin for being piercing-inserted into the prolonged hole of the elastic plate and the skid prevention part having a long hole formed therein for setting the elastic plate so that the fixation body is movable along the prolonged hole of the elastic plate, a flute part formed on the fixation body being combined with said protrusion part; and the fixation pin of the fixation body being inserted into and fixed to a combination groove and release groove formed in a righted-angle flute shape on the setting plate.

2. The pair of mountain-climbing shoes of claim 1, wherein said setting plates are formed symmetrically on a right and left side of back heel base of said each shoe and are provided with the combination holes formed on both sides thereof, an inner side of each said combination hole being provided with the combination groove and release groove, each of which is composed of an injection unit and a fixation unit and which are formed by the right-angle flute shape, said combination groove and release groove being set symmetrically in the right and left and being provided with the rotary shaft pin installed in a center thereof.

3. The pair of mountain-climbing shoes of claim 1, wherein said fixation pin is set in a center of said fixation body, and said fixation body having two sides with both sides folded downwards, two flute parts are formed on lower ending parts of the both sides, and in one side thereof, an upward folding part is formed.

4. A pair of mountain-climbing shoes, each said shoe of said pair having a heel, each said shoe comprising:

a non skid instrument for attaching to said heel of each said mountain-climbing shoes, and said heel having two parallel through-holes formed in a width direction and extended completely through said heel;

a pair of setting plates having a plurality of combinations holes, each said combination hole positioned over each of the through-holes;

at least one screw rod for entering one of said through-holes and one of said combination holes to mount said setting plates on said heel; and at least one skid prevention part having an outer surface, an aperture and a protrusion part formed on said outer surface, said at least one skid prevention part having a rotary shaft pin for entering said aperture and connecting said at least one skid prevention part to said setting plate, with said at least one skid prevention part rotatable centering around the rotary shaft pin;

an elastic plate having a prolonged hole fixed onto the skid prevention part; and a fixation body having a fixation pin for inserting into the prolonged hole of the elastic plate and the skid prevention part having a long hole formed therein for setting the elastic plate with the fixation body being movable along the prolonged hole of the elastic plate.

5. The pair of mountain-climbing shoes of claim 4, further comprising:

at least one fixation rod having a female screw end for entering the other end of the through-hole and one of said combination holes for receiving said screw rod form a fixation of said setting plate on said heel.

6. The pair of mountain-climbing shoes of claim 5, wherein said setting plates are symmetrically on a right and left side of said heel and the combination holes being formed on both sides thereof; and an inner side of each said combination hole having the combination and release grooves, each of which is formed as the right-angle flute shape, said combination and release grooves being set symmetrically in the right and left and being provided with the rotary shaft pin installed in a center thereof.

7. The pair of mountain-climbing shoes of claim 4, further comprising:

a flute part formed on the fixation body being combined with said protrusion part; and the fixation pin of the fixation body being inserted into and fixed to a combination and release groove formed in a righted-angle flute shape on the setting plate.

8. The pair of mountain-climbing shoes of claim 4, wherein said fixation pin is set in a center of said fixation body, and said fixation body having two sides with both sides folded downwards, two flute parts are formed on lower ending parts of the both sides, and in one side thereof, an upward folding part is formed.

* * * * *